US005579869A

United States Patent [19]

Ishii et al.

[11] Patent Number: 5,579,869

[45] Date of Patent: Dec. 3, 1996

[54] SECONDARY CONDUCTOR OF AN ELEVATOR-DRIVING LINEAR INDUCTION MOTOR

[75] Inventors: Toshiaki Ishii; Masamoto Mizuno, both of Aichi, Japan

[73] Assignee: Mitsubishi Denki Kabushiki Kaisha, Tokyo, Japan

[21] Appl. No.: 225,460

[22] Filed: Apr. 6, 1994

[30] Foreign Application Priority Data

Dec. 28, 1993 [JP] Japan ..... 5-338341

[51] Int. Cl.[6] ..... B66B 7/02; B66B 1/06

[52] U.S. Cl. ..... 187/289; 310/12; 187/406; 187/413

[58] Field of Search ..... 187/289, 414, 187/413, 406, 408; 310/12

[56] References Cited

U.S. PATENT DOCUMENTS

| | | | |
|---|---|---|---|
| 4,402,386 | 9/1983 | Ficheux et al. | 187/29 R |
| 5,086,881 | 2/1992 | Gagnon et al. | 187/17 |
| 5,235,145 | 8/1993 | Olsen et al. | 187/112 |
| 5,235,226 | 8/1993 | Olsen et al. | 310/12 |
| 5,345,047 | 9/1994 | Ishii et al. | 187/112 |

FOREIGN PATENT DOCUMENTS

| | | |
|---|---|---|
| 543169 | 2/1993 | Japan . |
| 585684 | 4/1993 | Japan . |

OTHER PUBLICATIONS

R. S. Phillips, "Electric Lifts", pp. 156–157, 1951.

*Primary Examiner*—Robert Nappi
*Attorney, Agent, or Firm*—Sughrue, Mion, Zinn, Macpeak & Seas

[57] ABSTRACT

This invention is concerned in a secondary conductor for an elevator-driving linear induction motor in which, in connecting secondary conductor members to one another, adjoining portions of secondary conductor members are cut and engaged with one another by lapping them over each other, and the edge portions of them are joined at least on one side with a fastening member or by pressure joining or by welding, whereby the difficulty is eliminated that the secondary conductor members, being bent for instance, are raised to form a step therebetween, so that the secondary conductor members are brought into contact with or struck against the primary windings of the linear induction motor, and the secondary conductor members and the primary windings are damaged.

4 Claims, 7 Drawing Sheets

SECONDARY CONDUCTOR OF AN ELEVATOR-DRIVING LINEAR INDUCTION MOTOR

BACKGROUND OF THE INVENTION

1) Field of the Invention

This invention relates to the secondary conductor of an elevator-driving linear induction motor.

2) Description of Related Art

The co-pending prior U.S. application Ser. No. 07/953,710 discloses an arrangement of the secondary conductor of an elevator-driving linear induction motor employable for a linear-motor-driven elevator as shown in FIGS. 12 and 13.

In FIGS. 12 and 13, reference numeral 1 designates walls of an elevating shaft; 2, secondary conductors of a linear induction motor which are mounted on the walls 1 of the elevating shaft; 3, brackets for fixedly mounting the secondary conductors 2 on the elevating shaft walls; 4, primary windings of the motor which confront with the secondary conductors 2, to cause the linear induction motor to generate a driving force; 5, U-shaped primary winding supports each supporting a pair of primary windings 4 which are confronted with each other through the secondary conductor 2; 6, an elevator driver on which a plurality of primary winding supports 5 are mounted; and 9, the connecting sections of the secondary conductor members which are connected in series to one another in the direction of movement of the elevator.

Further in FIGS. 12 and 13, reference numeral 10 designates a cage for transporting passengers; 13, a rope connected between the cage 10 and the elevator driver 6 to transmit the driving force from the latter 6 to the former 10; and 11 and 12, sheaves which receives the weight of the cage 10 and the weight of the driver 6 through the rope 13 and change the direction of tension of the rope 13.

FIGS. 14(*a*) and 14(*b*) are a perspective view and a sectional view, respectively, showing the connecting portions 9 of the secondary conductors 2. In FIGS. 14(*a*) and 14(*b*), reference numeral 8 designates bolts which are used to fixedly secure the secondary conductors 2 to the mounting bracket 3.

In the linear-induction-motor-driven elevator designed as described above, the cage is driven as follows: When current is supplied from a drive control unit (not shown) to the primary windings 4 confronted with one another, shifting magnetic field are produced in a direction perpendicular to the surface of the drawing FIG. 13. The shifting magnetic fields thus produced are applied to the secondary conductors 2 located between the primary windings 4, to induce induction eddy currents. The interaction of the eddy currents thus induced and the shifting magnetic fields produces a driving force to drive the elevator cage 10 with the aid of the driver 6 and the rope 13.

In the case where the secondary conductors of the linear induction motor are longitudinally laid over the walls of the elevating shaft with their connecting portions engaged with one another, the secondary conductors must be positively connected to one another; otherwise, the secondary conductors, being bent for instance, are raised forming steps which contact or strike the primary windings. In this case, both the secondary conductors and the primary windings may be damaged.

SUMMARY OF THE INVENTION

Provided according to the invention is a secondary conductor for an elevator-driving linear induction motor having primary windings mounted on an elevator cage or a counterbalancing weight to produce a driving force. The secondary conductor includes a plurality of secondary conductor members which are each arranged in an elevating shaft with a side portion thereof secured to the wall of the elevating shaft in such a manner that the secondary conductor members are arranged near the primary windings, and which are series-connected in a direction of movement of the elevator cage. Each secondary conductor member has connecting portions which are formed by cutting both end portions thereof so that the secondary conductor members are connected to one another through the connecting portions. The secondary conductor according to the invention further includes fastening members for fastening the secondary conductor members to one another through the remaining side portions thereof which are opposite to the side portions through which the secondary conductor members have been secured to the wall of the elevating shaft.

In the linear induction motor, the edge portions, on one side, of the secondary conductor members are fastened to each other with the fastening member such as bolts which are opposite to those, on the other side, of the secondary conductor members which are provided with no fastening means and have been secured to the wall of the elevating shaft, to prevent the secondary conductor members from separating from each other to form a step therebetween. The secondary conductor members may be secured to each other by cold pressure joining or by welding. On the other hand, since the secondary conductor members are generally raised to approach the primary windings, this difficulty may be eliminated by engaging a fastening member U-shaped in section with the lapping portions of the secondary conductor members which are formed by cutting. The fastening member U-shaped in section may be an elastic one, which contributes to simplification of the connecting operation. The two side plates of the fastening member which are confronted with each other may be wedge-shaped in section, to prevent the fastening member from coming off the secondary conductor members.

In cutting the secondary conductors members to form the lapping portions which are to be laid one on another, the secondary conductor members may be cut in such a manner that they includes the fastening members U-shaped in section as their own parts. In this case, it is unnecessary to provide the fastening member U-shaped in section as a separate component. In machining the adjoining secondary conductor members to connect them to each other, at least the parts of the secondary conductor members should not be machined which are confronted with the primary windings of the linear induction motor. This is to eliminate the difficulty as much as possible that the driving force of the motor is varied when the secondary conductor members are machined to connect them to one another.

With the secondary conductor of the invention, the connecting portions of the secondary conductor members laid one on another are secured to each other with the fastening means, so that the secondary conductor members are prevented from being raised and brought into contact with the primary windings.

DETAILED DESCRIPTION OF THE PREFERRED EMBODIMENTS

Preferred embodiments of this invention will be described with reference to the accompanying drawings.

First Embodiment

Figure 1A:
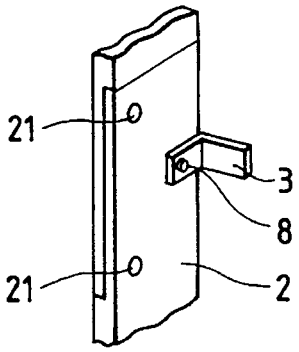
FIGS. 1(*a*), 1(*b*) and 1(*c*) are explanatory diagrams showing the connecting portions of secondary conductor members in an elevator-driving linear induction motor, which constitutes a first embodiment of the invention.
Figure 1B:
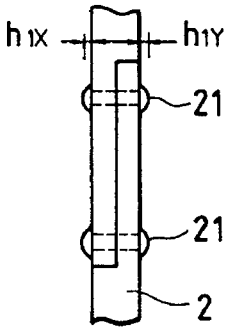
Figure 1C:
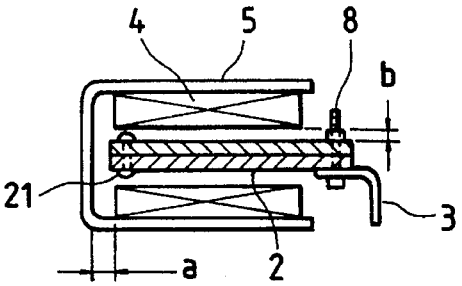

FIGS. 1(*a*) through 1(*c*) show essential parts of an elevator-driving linear induction motor according to a first embodiment of the invention, wherein FIG. 1(*a*) is a perspective view of the connecting portions 9 of adjoining secondary conductor members 2, FIG. 1(*b*) is a side view of the connecting portions 9 as viewed from one end face of the secondary conductor members 2, and FIG. 1(*c*) is a sectional view showing the secondary conductor members 2 together with primary windings 4 of the linear induction motor which confront with the secondary conductor.

In FIGS. 1(*a*) through 1(*c*), reference numeral 3 designates a bracket used to mount the secondary conductor members 2 on a wall of an elevating shaft; 8, a bolt and a nut which are used to connect the secondary conductor members 2 to the bracket 3; and 21, fastening members, namely, caulking pins which are inserted into through-holes formed in the lapped portions of the secondary conductor members 2.

In FIG. 1(*c*), reference character "a" designates the distance between the U-shaped bottom of a U-shaped primary winding support 5 and the ends of the primary windings 4; and "b", the distance between the secondary conductor member 2 and the surface of the iron core of the primary winding 4. In FIG. 1(*b*), reference characters "h1x" and "h1y" designate the amounts of protrusion of the caulking pins 21 (fastening members) from the secondary conductor members 2 on both sides.

In the elevator-driving linear induction motor designed as described above, the elevator cage is driven as follows: When the primary windings 4 are excited, shifting magnetic fields are formed, so that eddy currents are induced in the secondary conductor 2. The interaction of the eddy currents thus induced and the shifting magnetic fields produces a driving force to drive the elevator cage.

In this operation, the distance "b" between the primary winding 4 and the secondary conductor member 2 (shown in FIG. 1(*c*)) greatly affects the performance of the linear induction motor. In general, the distance is set to 2 to 3 mm.

If, when adjoining secondary conductor members are bent, their lapped portions are separated from each other, thus forming a step therebetween, then it may be impossible to place the secondary conductor members between the iron cores of the pair of primary windings 4. On the other hand, some of the connecting portions 9 of the secondary conductor members 2 are fixedly secured to the brackets 3 on the wall of the elevating shaft; that is, the connecting portions are secured on one side. In this case, the edge portions of the secondary conductor members should be fastened to each other with the fastening members at least on one side which is opposite to the side where they are secured to the brackets, to prevent the above-described separation of the lapped portions of the secondary conductor members.

In the case of FIGS. 1(*a*) through 1(*c*), the fastening members are the caulking pins; however, the caulking pins may be replaced with bolts and nut for the same effects. Furthermore, for the same effect, the following method may be employed: Threaded holes are formed in one of two secondary conductors to be laid one on another, and the secondary conductor members are joined together with bolts.

In the case of FIGS. 1(*a*) through 1(*c*), the bolts 8 used to secure the secondary conductor members to the brackets 3 on the wall of the elevating shaft are further used to fasten the secondary conductor members to each other; however, it goes without saying that bolts for connecting the secondary conductor members only may be provided.

Second Embodiment

Figure 2A:
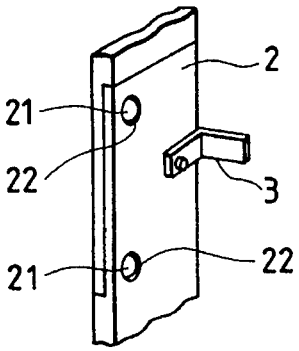
FIGS. 2(*a*), 2(*b*) and 2(*c*) are explanatory diagrams showing the connecting portions of secondary conductor members in an elevator-driving linear induction motor, which constitutes a second embodiment of the invention.
Figure 2B:
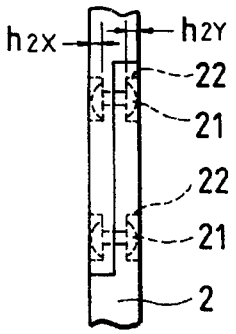
Figure 2C:
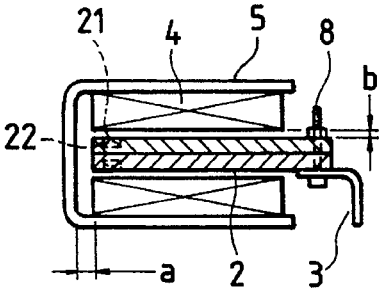

FIGS. 2(*a*), 2(*b*) and 2(*c*) show essential parts of an elevator-driving linear induction motor according to a second embodiment of the invention, wherein FIG. 2(*a*) is a perspective view of the connecting portions of secondary conductor connecting members 2, FIG. 2(*b*) is a side view of the connecting sections as viewed from one end face of the secondary conductor members 2, and FIG. 2(*c*) is a sectional view showing the secondary conductor members 2 together with primary windings of the linear induction motor. In FIGS. 2(*a*) through 2(*c*), reference numeral 22 designates counterbores for caulking pins 21, and reference characters "h2x" and "h2y" designate the depths of the counterbores 22.

It is assumed that the counterbores 22 are formed which meet h1x≦h2x and h1y≦h2y, and the pins 21 are caulked. In this case, the heads of the pins 21 thus caulked are sunk in the secondary conductor members which confront with the primary windings 4; that is, they are prevented from protruding from the surfaces of the secondary conductor members towards the primary windings 4.

Hence, the distance "h" between the primary winding 4 and the secondary conductor 2 is maintained unchanged, being free from the fastening members 21; that is, the distance may be set to a value predetermined for the performance of the linear induction motor. In the case of FIGS. 2(*a*) through 2(*c*), the counterbores are cylindrical; however, the invention is not limited thereto or thereby. For instance, the counterbores may be conical. In this case, flush bolts may be used to join the secondary conductor members together. In this connection, it goes without saying that groove-shaped recesses may be formed in the secondary conductor members for the same effect.

Figure 3:
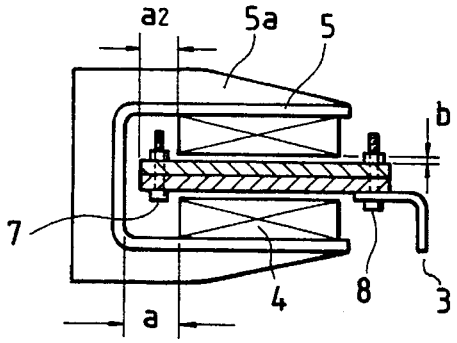
FIG. 3 is a sectional view of an elevator-driving section, for a description of the effects of the second embodiment.

The effects of the invention will be complementarily described with reference to FIG. 3. FIG. 3 is a sectional view showing secondary conductor members 2 and primary windings 4, which members are fastened to each other with fastening members, namely, bolts and nuts. In FIG. 3, reference character 5*a* designates a reinforcing member provided for the primary winding support 5. In the case of FIG. 3, fundamentally the distance "b" between the secondary conductor member 2 and the primary winding 4 is set to 2 to 3 mm. In order to eliminate the interference of the fastening members (the bolts and the nuts) 7 with the primary windings 4, the width of the secondary conductor members 2 is increased as much as "a2", as shown in FIG. 3; that is, the secondary conductor members 2 are protruded inside the primary winding support 5, and the dimension "a" of the primary winding support 5 is increased as much. Accordingly, the moment of force applied from the primary windings 4 to the U-shaped primary winding support 5 is increased. Hence, it is necessary to reinforce the primary winding support 5 with the reinforcing member 5*a* or the like.

In general, the secondary conductor members 2 have one and the same width over the entire length. Hence, in the secondary conductor members 2, their portions corresponding to the dimension "a2", except those of the connecting portions, do not contribute to the function of the motor so much. Hence, the portions corresponding to the dimension "a2" which do not confront with the primary windings 4, and the dimension "a" of the primary winding support 5 should be minimized. That is, sinking the fastening members as described above is effective in setting the dimensions "a" and "b" to suitable values.

Third Embodiment

Figure 4A:
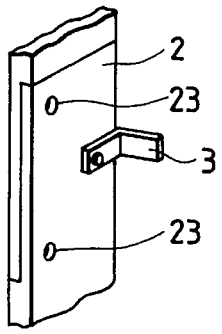
FIGS. 4(*a*), 4(*b*) and 4(*c*) are explanatory diagrams showing the connecting portions of secondary conductor members in an elevator-driving linear induction motor, which constitutes a third embodiment of the invention, which connecting portions have been secured to each other by cold pressure joining.
Figure 4B:
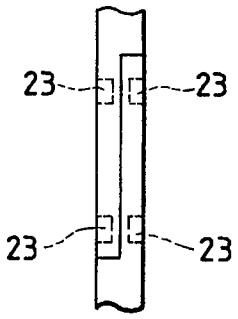
Figure 4C:
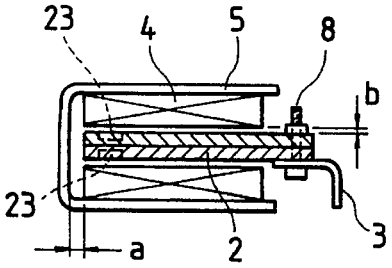
Figure 5A:
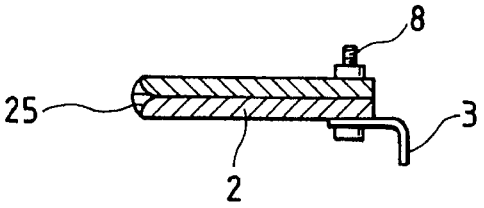
FIGS. 5(*a*) and 5(*b*) are explanatory diagrams showing the welded connecting portions of the secondary conductor members in the third embodiment, FIGS. 6(*a*), 6(*b*) and 6(*c*) are explanatory diagrams showing secondary conductor members in an elevator-driving linear induction motor, a fourth embodiment of the invention, which secondary conductor members are fastened to each other with a U-shaped holder.
Figure 5B:
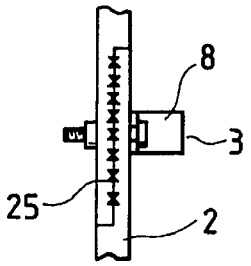

FIGS. 4(*a*) through 4(*c*), and 5(*a*) and 5(*b*) show a third embodiment of the invention. FIGS. 4(*a*), 4(*b*) and 4(*c*) show one example of the connecting portions of secondary conductor members where they are secured to each other by cold pressure joining (the fastening members 21 being not used). FIGS. 5(*a*) and 5(*b*) show another example of the connecting portions. In FIGS. 4(*a*), 4(*b*) and 4(*c*), reference numeral 23 designates recesses formed when the connecting portions are subjected to cold pressure joining. In FIGS. 5(*a*) and 5(*b*), reference numeral 25 designates the welding of the adjoining secondary conductor members. In the first and second embodiments, the secondary conductor members are secured to each other with the fastening members. On the other hand, in the third embodiment, no fastening member is used to join the secondary conductor members together.

In the case of FIGS. 4(*a*) through 4(*c*), the secondary conductor members 2 laid one on another are joined together by cold pressure joining, forming the recesses 23 therein. In order to join the secondary conductor members 2 in this manner, the members 2 are generally made of aluminum material. In the cold pressure joining operation, the secondary conductor members are plastically deformed about 60%, thus forming the recesses 23. On the other hand, the cold pressure joining operation is carried out with a predetermined tool. That is, with the predetermined tool, even a person not skilled in the operation is able to join the secondary conductor members together with high quality. Hence, in the case where it is necessary to perform the secondary conductor member joining operation at a site under construction as in the case of the installation of an elevator, the third embodiment may be effectively employed with high work efficiency and with high quality.

In the case of FIGS. 5(*a*) and 5(*b*), the second conductor members laid one on another are welded together as follows: That is, the edge portions of the secondary conductor members are welded on one side as indicated at 25; that is, at least the edge portions are welded together which are opposite from the edge portions which are closer to the wall of the elevating shaft. In this case, the effects are the same as those in the above-described case. The edge portions of the secondary conductor members are welded, which are located away from the wall of the elevating shaft. Hence, the edge portions can be welded from the front; that is, they can be welded with high work efficiency. On the other hand, in order to maintain the performance of the motor unchanged, it is necessary to keep a predetermined distance between the primary winding 4 and the secondary conductor 22 as indicated at "b" in FIG. 4(*c*). In the case of FIGS. 5(*a*) and 5(*b*), this requirement can be satisfied with ease, because a padding or expanding portion may be readily formed on the edge portions of the secondary conductors by welding.

Fourth Embodiment

Figure 6A:
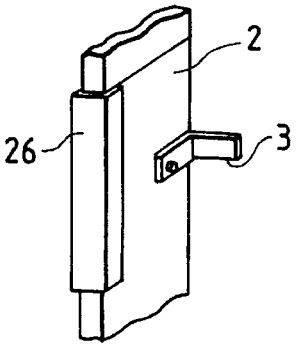
Figure 6B:
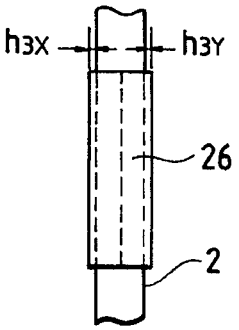
Figure 6C:
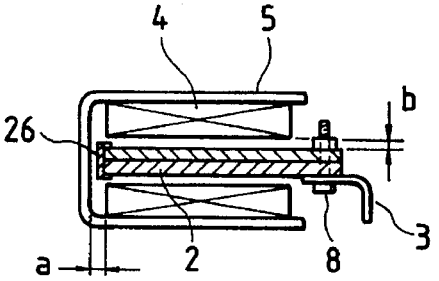
Figure 7A:
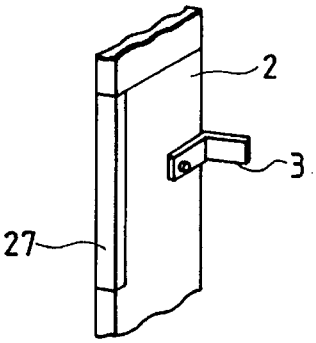
FIGS. 7(*a*), 7(*b*), 7(*c*) 7(*d*) and 7(*e*) are explanatory diagrams showing the connecting portions of the secondary conductor members in the fourth embodiment which connecting portions are joined with a U-shaped holder whose width is equal to the sum of the thicknesses of the secondary conductor members.
Figure 7B:
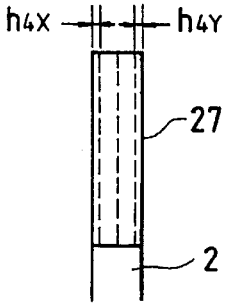
Figure 7C:
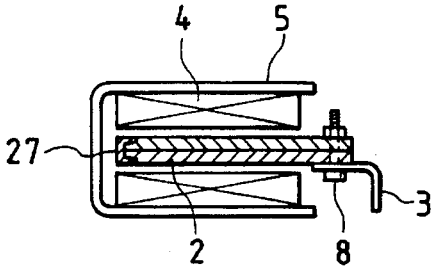
Figure 7D:
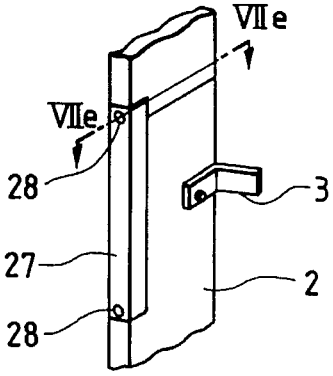
Figure 7E:
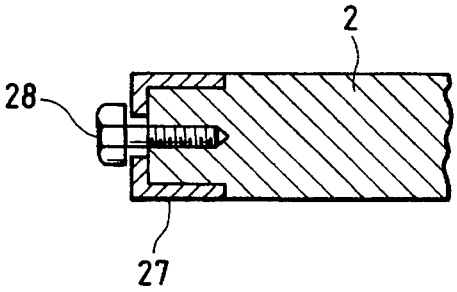
Figure 8A:
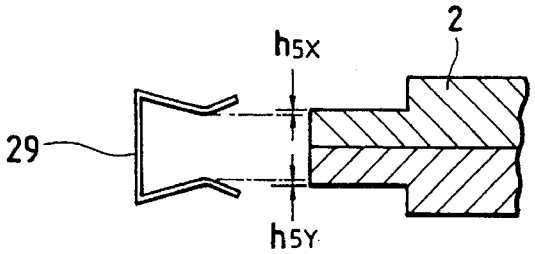
FIGS. 8(*a*) and 8(*b*) are explanatory diagrams showing the connecting portions of the secondary conductor members in the fourth embodiment which connecting portions are fastened to each other with an elastic U-shaped holder.
Figure 8B:
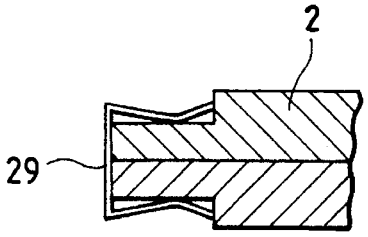
Figure 9A:
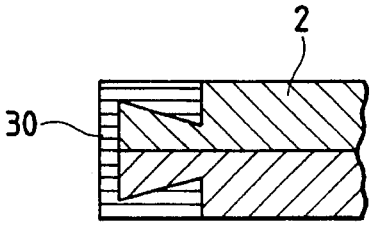
FIGS. 9(*a*) and 9(*b*) are explanatory diagrams showing the connecting portions of the secondary conductor members in the fourth embodiment which connecting portions are fastened to each other with a U-shaped holder having wedge-shaped portions.
Figure 9B:
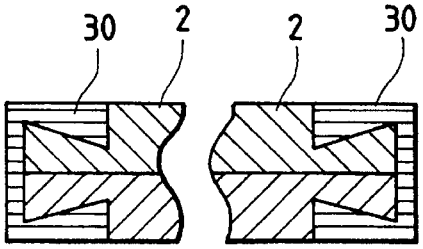

FIGS. 6(*a*) through 9(*b*) show a fourth embodiment of the invention. In the cases of FIGS. 6(*a*) through 6(*c*) and FIGS. 7(*a*) through 7(*e*), fastening members U-shaped in section are employed (hereinafter referred to as "U-shaped holders", when applicable). In the case of FIGS. 8(*a*) and 8(*b*), second conductor members lapped over each other are held with an elastic U-shaped holder. In the case of FIGS. 9(*a*) and 9(*b*), a U-shaped holder has wedge-shaped portions to join second conductor members.

In FIG. 6(*a*) through 6(*c*), reference numeral 26 designates the aforementioned U-shaped holder holding the second conductor members, and reference characters h3x and h3y designate the thicknesses of two side plates of the U-shaped holder 26 which are confronted with each other. In FIGS. 7(*a*) through 7(*c*), reference numeral 27 designates the aforementioned U-shaped holder. The U-shaped holder 27 is similar to the one 26 shown in FIGS. 6(*a*) through 6(*c*) except that the distance between the outer surfaces of two side plates of the U-shaped holder 27 which are confronted with each other is equal to the sum of the thicknesses of the secondary conductor members lapped over each other. Further in FIG. 7(*b*), reference characters h4x and h4y designate the thicknesses of the two side plates of the holder, and the depths of grooves which are formed in the end portions of the secondary conductor members so as to be engaged with the U-shaped holder 27. Further in FIG. 7(*d*) and 7(*e*), reference numeral 28 designates screws for fastening the U-shaped holder to the secondary conductor members 2.

The U-shaped holder 26 or 27 is used as follows: The secondary conductor members mounted on the wall of the elevating shaft on one side are inserted in the U-shaped holder on the other side, so that the secondary conductor members lapped over each other are prevented from separating from each other. As was described above, in the U-shaped holder 27, the distance between the outer surfaces of the side plates is equal to the sum of the thicknesses of the secondary conductor members. Hence, with the employment of the U-shaped holder 27, the dimension "a" can be decreased similarly as in the case of the second embodiment. The U-shaped holder 26 or 27 may be secured to the edge portion of the lapped secondary conductor members with screws as shown in FIGS. 7(*d*) and 7(*e*).

In FIGS. 8(*a*) and 8(*b*), reference numeral 29 designates the aforementioned U-shaped holder having two elastic side plates which are confronted with each other, and reference characters h5x and h5y represent the difference between the distance between the inner surfaces of the two side plates of the U-shaped holder 29 and the distance between the outer surfaces of the secondary conductor members lapped over each other. That is, when the U-shaped holder 29 is engaged with the secondary conductor members, the two side plates are spread as much as (h5x+h5y), thus producing a pushing force to hold the secondary conductor members and to retain the holder itself. In FIGS. 8(*a*) and 8(*b*), the two side plates of the U-shaped holder 29 are bent inwardly; however, the invention is not limited thereto or thereby. That is, all that is necessary for the two side plates is that they are elastic towards each other. The portions of the secondary conductor members which are engaged with the U-shaped holder 29 may be shaped according to the configuration of the holder 29 engaged with the former (no figure being provided therefor).

In FIGS. 9(*a*) and 9(*b*), reference numeral 30 designates the aforementioned U-shaped holder having the wedge-shaped portions. The U-shaped holder 30 comprises: one end plate on one side; and two side plates which are extended from both sides of the one end plate in such a manner that they are confronted with each other, thus forming an open end on the other side. And the thicknesses of the two side plates of the U-shaped holder 30 are larger towards the open end of the latter 30. In FIG. 9(*b*), the U-shaped holders 30 are fixedly engaged with on both edge portions of the secondary conductor members laid one on another. The two side plates of the U-shaped holder 30 are wedge-shaped as was described above, and the engaging portions of the secondary conductor members are also wedge-shaped. Hence, the U-shaped holder 30 can be engaged with the secondary conductor members as follows: First, one of the secondary conductor members is engaged with the holder 30, and then the remaining secondary conductor member is inserted longitudinally into the space defined by the secondary conductor member and the holder 30. Thus, the secondary conductor members can be readily held with the U-shaped holder as in the dovetail connection.

Fifth Embodiment

A fifth embodiment of the invention will be described with reference to FIGS. 10(*a*) and 10(*b*).

Figure 10A:
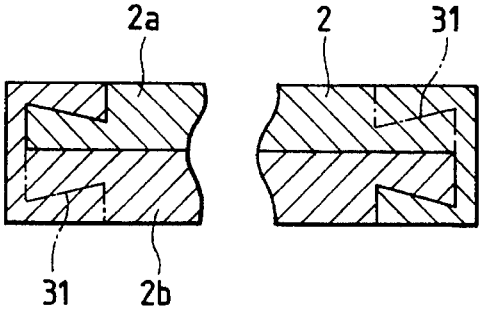
FIGS. 10(*a*) and 10(*b*) are explanatory diagrams showing secondary conductor members in an elevator-driving linear induction motor, a fifth embodiment of the invention, which secondary conductor members have connecting portions which are integral with U-shaped holders.
Figure 10B:
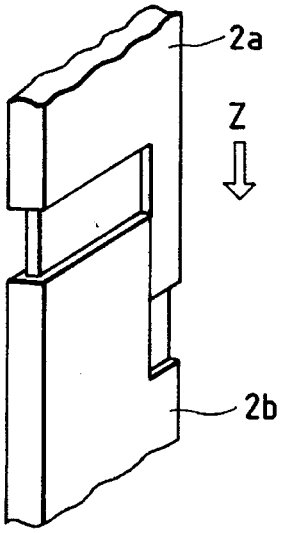

FIGS. 10(*a*) and 10(*b*) show the connecting portions of the secondary conductor members which are made integral with the U-shaped holder having the wedge-shaped side plates (the fourth embodiment). More specifically, FIG. 10(*a*) is a sectional view of the connecting portions, and FIG. 10(*b*) is an explanatory diagram showing the second conductor members which are being connected to each other. In FIGS. 10(*a*) and 10(*b*), reference characters 2*a* and 2*b* designate the second conductor members to be joined together, and reference numeral 31 designates phantom lines which are provided when the secondary conductor members and the U-shaped holders are provided separately as in the case of FIGS. 9(*a*) and 9(*b*). Further in FIG. 10, the arrow Z designates the direction of engagement of one of the adjoining next secondary conductor members 2*a* and 2*b* to the other.

In the fifth embodiment, the U-shaped holder is formed in the end portion of the secondary conductor member. Therefore, two secondary conductor members can be engaged with each other by inserting one of them into the other in the direction of the arrow Z. That is, the secondary conductor members can be connected more readily than those shown in FIGS. 9(*a*) and 9(*b*).

In the fourth embodiment shown in FIGS. 7(*a*) through 7(*c*), the two side plates of the U-shaped holder are not wedge-shaped; however, the secondary conductor member may be so modified that it is integral with the U-shaped holder. In this case, similarly as in the above-described case, the secondary conductor members laid one on another can be prevented from being separated from each other; however, the secondary conductor members, being different from those having the wedge-shaped portions, are not sufficiently fixed in the direction which is in parallel with the surfaces of the secondary conductor members which confront with the primary windings, and therefore it is necessary to fasten the adjoining secondary conductor members to each other with the bolts 8 as shown in FIG. 7. However, the connecting operation can be achieved with ease, being free from the limitation that the secondary conductor member must be moved in the direction of the arrow Z in FIG. 10(*b*).

Sixth Embodiment

Figure 11A:
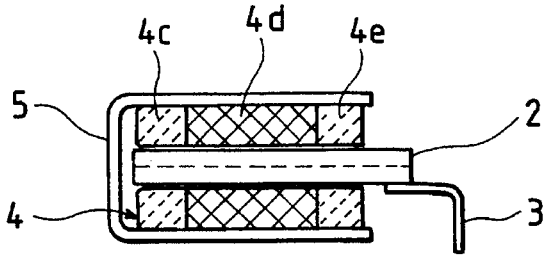
FIGS. 11(*a*) and 11(*b*) are explanatory diagrams for a description of the machinable part of a secondary conductor in an elevator-driving linear induction motor, which constitutes a sixth embodiment of the invention.
Figure 11B:
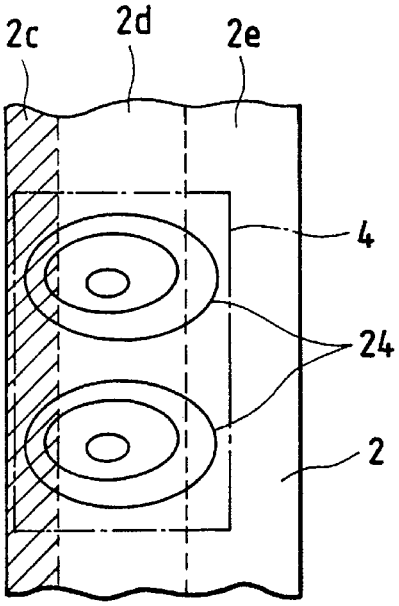
Figure 12:
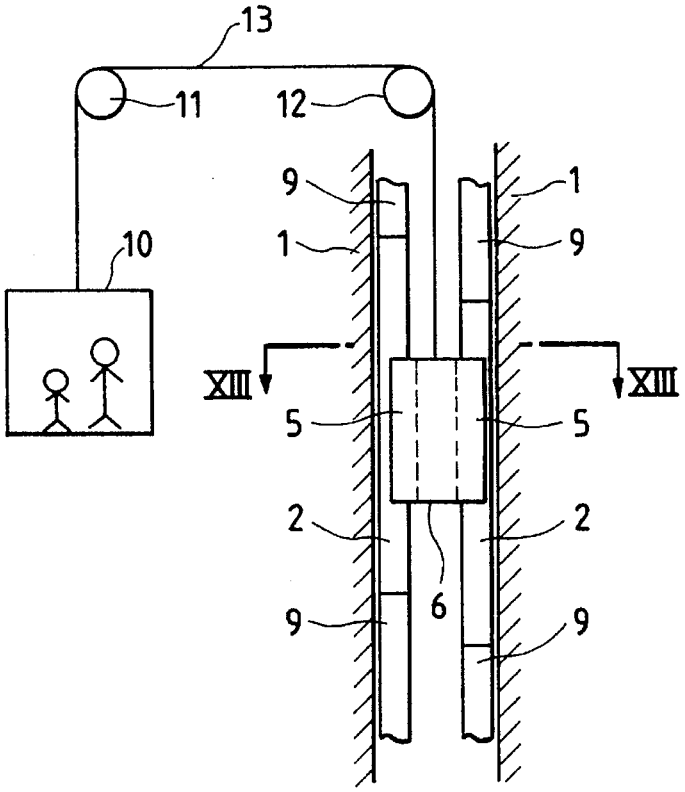
FIG. 12 is an explanatory diagram showing one example of an elevator driven by a linear induction motor.
Figure 13:
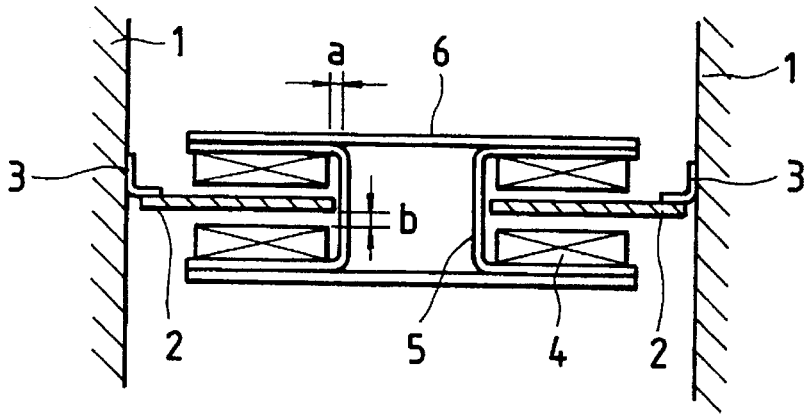
FIG. 13 is a sectional view of a drive section in the elevator-driving linear induction motor shown in FIG. 12.
Figure 14A:
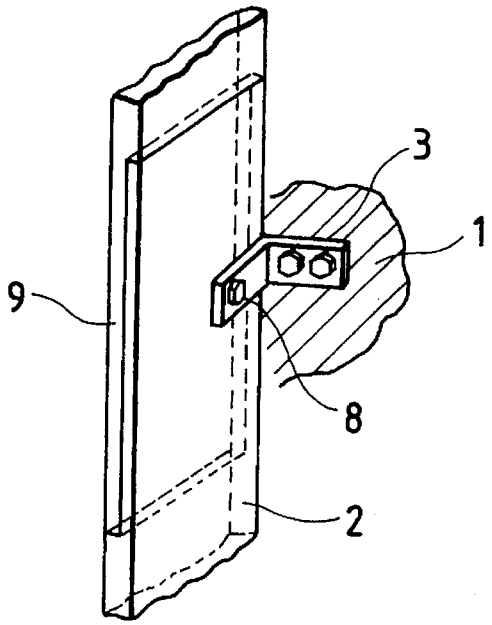
FIG. 14(*a*) and 14(*b*) are explanatory diagrams showing the connecting portions of secondary conductor members in the elevator-driving linear induction motor shown in FIG. 12.
Figure 14B:
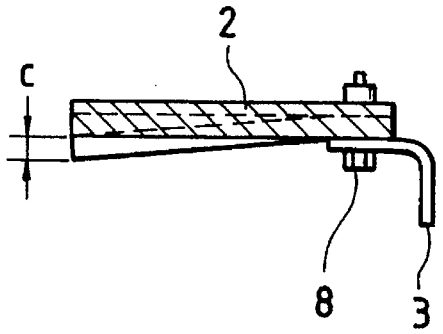

FIGS. 11(*a*) and 11(*b*) show a sixth embodiment of the invention.

In FIGS. 11(*a*) and 11(*b*), reference characters 4*c* and 4*e* designate the coil ends of the primary windings 4 of the linear induction motor; 4*d*, the iron cores of the primary windings 4; 2*c*, one end portion of the secondary conductor which is not confronted with the iron cores 4*d* of the primary windings 4; 2*d*, the portion of the secondary conductor which confronts with the iron cores 4*d* of the primary windings 4; 2*e*, the other end portion of the secondary conductor which is not confronted with the iron cores 4*d* of the primary windings 4 and is mounted on the wall of the elevating shaft; and 24, eddy currents induced in the secondary conductor by the primary windings 4.

The linear induction motor produces a driving force as follows: When shifting magnetic fields are formed by the primary windings, eddy currents are induced in the secondary conductor. The interaction of the eddy currents and the shifting magnetic fields produces the driving force. If the secondary conductor is drilled or is combined with other members, its electrical resistance is locally increased to adversely affect the flow of eddy currents, thus lowering the driving force.

On the other hand, the eddy currents in the portion 2*d* of the secondary conductor which confronts with the iron cores of the primary windings contribute to the production of the driving force more than those in the end portions 2*c* and 2*e* which confront with the coil ends of the primary windings. Hence, when it is required to machine the secondary conductor, in order to maintain the performance of the motor unchanged as much as possible the portion 4*d* should not be machined which confronts with the iron cores of the primary windings; that is, the other portions other than the portion 4*d* should be machined.

The elevator-driving linear induction motor according to the invention has the following effects or merits: When the secondary conductor members are cut and connected to one another by lapping them over each other, the edge portions of the secondary conductor members are fastened to each other with the fastening member or by pressure joining or by welding at least on one side. Hence, the difficulty is eliminated according to the invention that the secondary conductor members, being bent for instance, are raised to form a step therebetween, as a result of which the secondary conductor members are brought into contact with or struck against the primary windings of the linear induction motor, whereby the secondary conductor members and the primary windings are both damaged.

What is claimed is:

1. A secondary conductor for an elevator-driving linear induction motor, comprising:

a plurality of secondary conductor members which are each arranged in an elevating shaft with a portion thereof secured to the wall of said elevating shaft, said secondary conductor members being series-connected in a direction of movement of said elevator, said secondary conductor members each being partially cut away at end portions thereof such that adjacent secondary conductor members are joined in a substantially tongue and groove manner; and U shaped holder means for further securing said adjacent secondary conductor members to one another at said tongue and groove joining location, wherein said U shaped holder means is integral with said secondary conductors.

2. A secondary conductor for an elevator-driving linear induction motor, comprising:

a plurality of secondary conductor members which are each arranged in an elevating shaft with a portion thereof secured to the wall of said elevating shaft, said secondary conductor members being series-connected in a direction of movement of said elevator, said secondary conductor members each being partially cut away at end portions thereof such that adjacent secondary conductor members are joined in a substantially tongue and groove manner; and U shaped holder means for further securing said adjacent secondary conductor members to one another at said tongue and groove joining location, wherein said U shaped holder means comprises an end plate, and two side plates, which extend from both sides of said end plate in a manner confronting with each other, said side plates comprising wedge-shaped portions which extend into thinned portions of said secondary conductors.

3. A secondary conductor for an elevator-driving linear induction motor, comprising:

a plurality of secondary conductor members which are each arranged in an elevating shaft with a side portion thereof secured to the wall of said elevating shaft, and which are series-connected in a direction of movement of said elevator, said secondary conductor members each being partially cut away to form a lapping portion;

lapping portions of adjacent secondary conductor members being overlapped on one another to connect the secondary conducting members in said direction of movement;

engaging means for engaging said secondary conducting members at said lapping portions and for urging said lapping members together in surface contact, said engaging means comprising U-shaped spring members having an opening smaller than a combined thickness of said lapping portions at locations adjacent said opening, such that a spring biasing force is exerted on said lapping portions when said lapping portions are located within said opening.

4. A secondary conductor for an elevator-driving linear induction motor, comprising:

a plurality of secondary conductor members which are each arranged in an elevating shaft with a side portion thereof secured to the wall of said elevating shaft, and which are series-connected in a direction of movement of said elevator, said secondary conductor members each being partially cut away to form a lapping portion;

lapping portions of adjacent secondary conductor members being overlapped on one another to connect the secondary conducting members in said direction of movement;

engaging means for engaging said secondary conducting members at said lapping portions and for urging said lapping members together in surface contact, said engaging means comprising U-shaped members comprising an end plate, and two side plates which extend from both sides of said end plate in a manner confronting with each other, said side plates comprising wedge-shaped portions which extend into thinned portions of said secondary conductors to define an opening smaller than a combined thickness of said lapping portions at locations adjacent said opening.

* * * * *